United States Patent [19]

de Hek

[11] 4,436,591

[45] Mar. 13, 1984

[54] PROCESS OF ELECTROFORMING SCREEN MATERIAL

[75] Inventor: Johan A. de Hek, Arnhem, Netherlands

[73] Assignee: Veco Beheer B.V., Netherlands

[21] Appl. No.: 429,447

[22] Filed: Sep. 30, 1982

[30] Foreign Application Priority Data

Nov. 13, 1981 [NL] Netherlands ..... 8105150

[51] Int. Cl.[3] ..... C25D 1/08; C25D 7/00

[52] U.S. Cl. ..... 204/11; 204/24; 204/DIG. 9

[58] Field of Search ..... 204/11, 24, DIG. 8, 204/DIG. 9

[56] References Cited

U.S. PATENT DOCUMENTS

| | | | |
|---|---|---|---|
| 2,226,381 | 12/1940 | Norris | 204/11 |
| 2,226,384 | 12/1940 | Norris | 204/11 |
| 2,678,909 | 5/1954 | Jernstedt | 204/DIG. 9 |
| 2,706,170 | 4/1955 | Marchese | 204/3 |

FOREIGN PATENT DOCUMENTS

| | | | |
|---|---|---|---|
| 0038104 | 4/1981 | European Pat. Off. | 204/11 |
| 2739427 | 3/1978 | Fed. Rep. of Germany | 204/DIG. 9 |
| 717157 | 2/1980 | U.S.S.R. | 204/DIG. 9 |

OTHER PUBLICATIONS

Modern Electroplating, Edited by F. A. Towenheim, Third Edition, 1974, pp. 296–305.

IBM Technical Disclosure Bulletin, vol. 16, No. 3, Aug. 1973, pp. 979, 980.

Metal Finishing, vol. 77, May 1979, pp. 33–38, Tai Ping Sun et al., Plating with pulsed and periodic reverse current.

*Primary Examiner*—T. M. Tufariello

*Attorney, Agent, or Firm*—Ostrolenk, Faber, Gerb & Soffen

[57] ABSTRACT

A screen skeleton as a cathode is subjected to a pulsed current for depositing metal from an electrolytic bath onto the metal regions of the screen skeleton, said electrolytic bath containing a brightener of the second class. This process involves growth of metal substantially perpendicular to the screen skeleton surfaces thus maintaining the size of the openings of the screen skeleton.

Small pulse current durations are advantageous. Preferably a pulsed current is used comprising pulse current and non-pulse current durations; more preferably the pulse current durations are subdivided into small pulse current and non-current pulse periods.

14 Claims, 9 Drawing Figures

PROCESS OF ELECTROFORMING SCREEN MATERIAL

BACKGROUND OF THE INVENTION

The present invention relates to a process of electrolytically producing material particularly screen material, by depositing in an electrolytic bath a metal upon a basic material in the presence of at least one brightener.

U.S. Pat. No. 2,226,384 describes a process of electrolytically producing a screen by electrolytically depositing a metal upon a screen skeleton formed in a first stage. The electrolytically formed screen may be removed from the screen skeleton by previously applying a stripping means, such as e.g. beeswax upon the screen skeleton, provided that the lower side and the sides of said skeleton comprise an electrically insulating material preventing a metal deposit at said regions.

Said known process presents the drawback that during the electrolytic deposit the lands in the basic screen material or screen skeleton will grow around the metal parts of the screen skeleton, so that finally a screen material is obtained having small mesh openings whilst the lands will possess a more or less rounded cross-section.

SUMMARY OF THE INVENTION

The present invention aims to provide process for electrolytically producing material particularly screen material, which does not present this drawback and in which particularly the increase of deposited metal upon a basic material or a screen skeleton is performed solely or substantially solely in one direction perpendicular to the basic material particularly basic screen material. The mesh openings of the basic material or of the screen skeleton are substantially maintained in the screen produced according to the invention.

In the process according to the invention, metal screens can more particularly be produced, comprising the basic screen material or not, which present a maximum passage combined with a maximum strength in practically any desired mesh size, the openings in the screen material being so formed that they substantially increase their dimensions only toward one side, so that any danger of clogging of the apertures when the screen is used for filtering procedures, is practically reduced, this contrary to processes in which a deposit growth all over the basic screen material occurs.

This is achieved according to the invention in that the metal is deposited upon the basic screen material by means of a pulsed current, said pulsed current causing a deposit of metal substantially perpendicular to the surface of the basic material or the basic screen skeleton. In this way the passages of the mesh openings of the basic material or the screen skeleton are substantially maintained.

The process according to the invention is preferably performed in an electrolytic bath comprising at least one brightener, which consists of an organic compound comprising at least one unsaturated bond which does not below to a

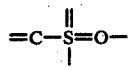

group. The latter preferably, a brightener of the second class, consists of butynediol, or ethylene cyanohydrin.

The presence of such a brightener particularly provides the desired results in the form of screen material, having mesh openings substantially corresponding to those in the initial basic screen material.

The pulsed current advantageously comprises pulse current durations separated by non-current pulse durations or successive reverse pulse current periods.

The ratio of the length of a pulse current duration compared with a non-current pulse duration, a reverse pulse current duration respectively, amounts to $T:T^1$ whereby T and $T^1$ are each separately adjustable between 0.1 and 9900 msec.

A very appropriate growth of metal in a direction, perpendicular to the basic screen material is obtained when the pulse current duration T is comprised between 0.1 and 10 msec, more preferably between 0.1 and 1.0 msec. Short pulse current durations will provide a more preferred, deposit of metal upon the basic screen material as compared with longer pulse current durations.

The ratio between T and $T^1$ is advantageously comprised between 1:1 and 1:1000, particularly between 1:1 and 1:20 and more particularly between 1:5 and 1:15.

Extremely good results are obtained when the pulse current duration is sub-divided into small pulses comprising pulse current and pulse non-current periods t and $t^1$ whereby the frequency $$f = \frac{1}{t + t^1}$$

is selected between 10.2 and 10.4 Hz and the ratio $$C = \frac{t}{t + t^1} \times 100\%$$

is selected between 0 and 100%.

Preferably for depositing metal upon the basic screen material a pulsed current is applied comprising pulse current and pulse non-current durations, since increase ratios of 25 and higher are obtained hereby, without any disadvantageous influence of the original mesh openings in the basic screen material.

The invention is also embodied in apparatus for performing the process of the invention, and comprising an anode retaining member, a cathode retaining member for fixing a basic screen material, an anode joining element and a cathode joining element, as well as a vessel for receiving an electrolytic bath, said apparatus comprising a device for generating a pulsed current. The device for generating a pulsed current is generally known. (see e.g. Plating 1970; No. 5, page 1105: Design factors in Pulse plating; A. J. Avila M. J. Brown).

DESCRIPTION OF THE PREFERRED

Figure 5:
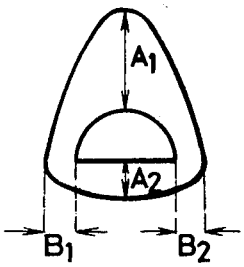
FIG. 5 is a diagram showing the data for plotting the deposit ratio.
Figure 6A:
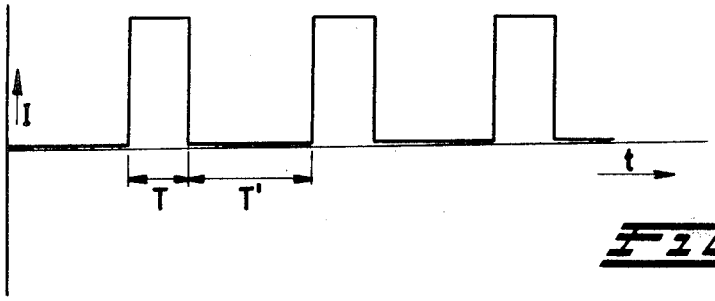
FIG. 6*a* is a current (I)-duration (t) graph illustrating the various current changes between pulse current (T) and non-current pulse ($T^1$) periods; in the tests this method is indicated as current PP.
Figure 6B:
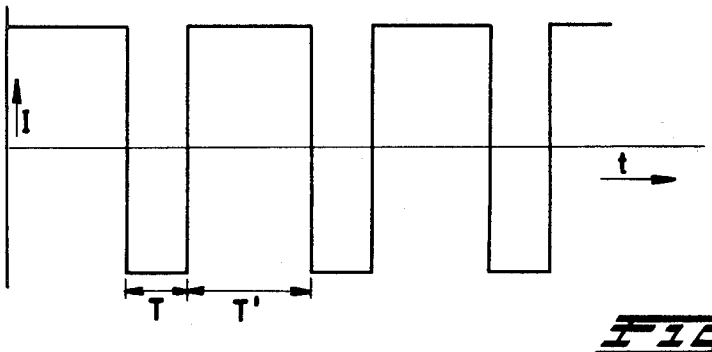
FIG. 6*b* is a current (I)-duration (t) graph, illustrating the various current changes between alternate pulse current durations T and reverse pulse current durations $T^1$; this method is indicated as current PR.
Figure 6C:
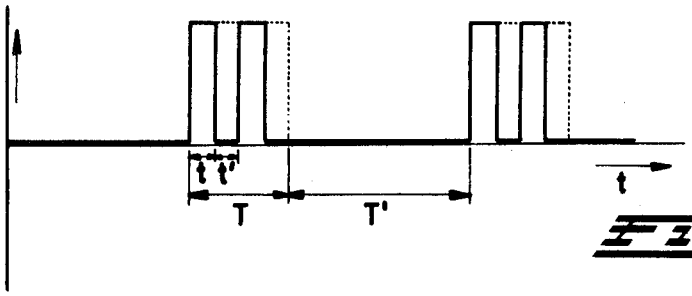
FIG. 6*c* is a current (I)-duration (t) graph, illustrating the various current changes as in FIG. 6*a* but the pulse current durations T are each subdivided into alternate pulse current durations t and non-current pulse durations $t^1$, said process is illustrated in the tests as current PPP.
Figure 6D:
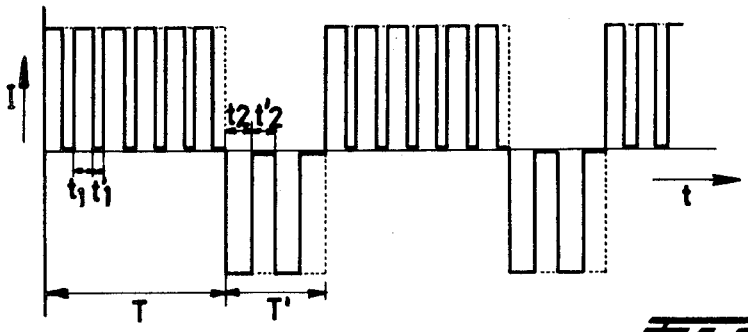
FIG. 6*d* is a current (I)-duration (t) graph illustrating current changes as in FIG. 6*b*, the pulses current durations T in one direction being subdivided into pulse current durations $t^1$ and non current pulse durations $t_i$, the reverse pulse current periods $T^1$ being subdivided into pulse current durations $t^2$ and non current pulse durations $t^{2'}$; which process is illustrated in the tests as current PPR.

In order to illustrate the results obtained, the definition: increase ratio consisting of:

$$\frac{A1 + A2}{B1 + B2},$$

is used, the magnitudes A1, A2, B1 and B2, being illustrated in FIG. 5.

The present invention will furthermore be elucidated with respect to a number of examples.

In a Watt's nickel bath, known in the art, comprising per liter of bath liquid at least 80 mg of 2-butyne 1,4-diol as brightener a nickel screen plate 1 covered with beeswax is installed in a vertical direction as a cathode. The used nickel bath comprises per liter 250 to 300 g $NiSO_4.6H_2O$, 25 to 35 g $NiCl_2.6H_2O$ and 30 to 40 g $H_3BO_3$ and has a pH ranging from 3.5 to 4.5 while the temperature varies from 55° to 65° C. Said bath can be used for current amplitudes to 20 A/dm$^2$. The butynediol may be replaced by ethylene cyanohydrin.

The screen plate 1 is provided with slit-shaped openings 3, having a width of 120 μm, said openings being separated from one another by lands 2 bounded by land top sides 2*a* and land lower sides 2*b*.

The following table shows the varying circumstances during the tests and the ratio of metal increase.

TABLE A

| | No. | Current type | data rectifier | data pulse device | parameters T (msec) | T1 (msec) | f | C | Increase ratio |
|---|---|---|---|---|---|---|---|---|---|
| I | DC1 | DC | 5,8A/5,5V | — | — | — | — | — | 2,5 |
| II | PP1A | PP | — | 5,8A/7,1V | 0,1 | 1 | — | — | 25 |
| III | PP1B | PP | — | oscillating | 100 | 1000 | — | — | not definable |
| IV | PP1C | PP | 5,8/7,5V | 5,8A/6,6V | 10 | 100 | — | — | 2,4 |
| V | PP2AII[x] | PP | 2A/4,6V | 2,1A/3,3V | 0,1 | 3 | — | — | — |
| VI | PP2BIII | PP | — | 2,1A/3,3V | 10 | 300 | — | — | 4,4 |
| VII | PPP1A | PPP | 2,3A/15V | 2,6A/3,3V | 0,1 | 1 | 40 | 50 | 5,6 |
| VIII | PPP1B | PPP | 2,2A/10V | 2,6A/3,6V | 10 | 100 | 0,4 | 50 | 6,5 |
| IX | PP 3AII | PP | 2,5A/16V | 2,5A/2,3V | 9900 | 0 | 9 | 10 | 7,4 |

Figure 4:
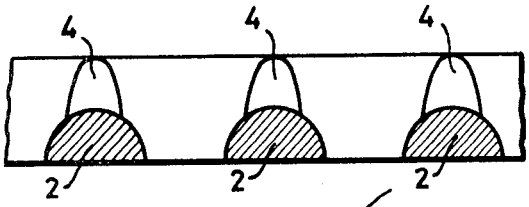
FIG. 4 is a screen material, obtained by performing a modified process according to the invention while using the basic screen material of FIG. 2.

[x]increase only on top, not on lower side (see FIG. 4)

EMBODIMENTS

Figure 1:
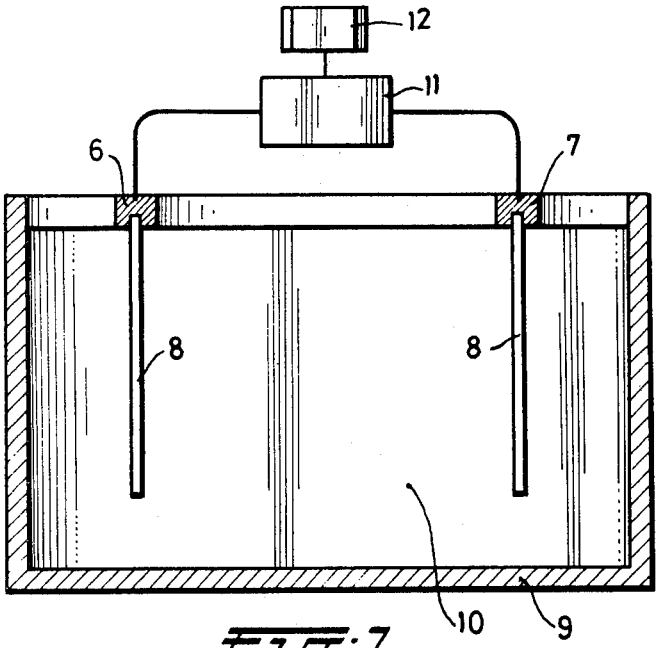
FIG. 1 is an apparatus for performing the process of the invention.
Figure 2:
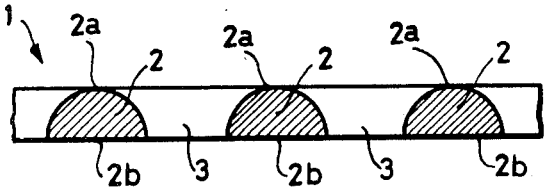
FIG. 2 is a section of a basic screen material.

FIG. 1 shows apparatus for electrolytically producing screen material by depositing in an electrolytic bath a metal upon a basic screen material, the electrolytic bath at least comprising one brightener.

Said apparatus comprises a vessel 9 for the receipt of an electrolytic bath 10, while it is further provided with a cathode retaining means 6 for retaining a basic screen material 1.

On the other hand an anode retaining means 7 is provided for retaining an anode material.

The cathode retaining means 6 and anode retaining means 7 are connected to a device 11 for generating a pulsed current said device 11 being connected to a D.C. source 12.

Figure 3:
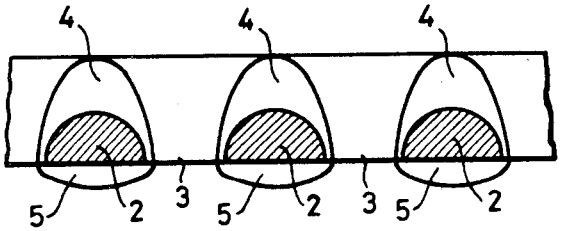
FIG. 3 is a screen material obtained by applying the process according to the invention, starting from the basic screen material of FIG. 2.

Starting from a basic screen material 1 comprising mesh openings 3 bounded by lands 2 with top sides 2*a* and lower sides 2*b*, a screen material according to FIG. 3 is obtained due to the use of a pulsed current consisting of alternate pulse current and non-current pulse durations, whereby the metal deposited during the electrolysis has substantially accumulated in the increase region 4, said increase region 4 substantially extending perpendicular to the basic screen material.

Only a slight quantity of metal is deposited upon the lower side 2*b* of the lands, said material being illustrated by means of the second increase region 5.

From the above it appears that micro pulses having a magnitude of 0.1 to 1 msec are more active than macro pulses comprised between 10 to 100 msec, (see for comparison test results II and IV in the table).

From these results it follows that a pulsed current having alternate pulse current and non pulse current durations, gives very good results, while the use of a pulsed current duration comprising alternate pulse current periods in one given direction and a reverse pulse current period may provide equal results, although the current yield will decrease.

On comparing test results II and VI to test result I (table A) it will moreover be obvious that a pulsed current clearly influences the ratio of metal increase, provided that micro pulses are used. When macro pulses are used, said notable differences in the metal increase ratio will occur only to a lesser extent.

The use of longer non-current pulse periods separating the pulse current periods increases the ratio of metal deposit increase (see e.g. results IV and VI in the table), while the use of pulse current periods built up from a great number of alternate small pulse current durations and non-current pulse durations, will not result in a higher ratio of metal deposit increase (see e.g. results II and VII in the table), although in the event of macro pulses there will yet be a positive effect (see e.g. results IV and VIII in the table).

The effects of the above appear, however, to be strongly dependent upon the type of materials as used.

The distance between the cathode 1 in the form of a nickel screen plate, and a nickel anode 8 amounts to 60 mm, whilst the amplitude of the switched on DC amounts to 5 $A/dm^2$, measured across the total surface of the cathode 1. The temperature of the bath liquid amounts of 60° C., and the results as illustrated in the table were obtained after an electrolytic procedure of 60 minutes. In view of the presence of beeswax upon the top side 2*a* of the lands 2, a ready-made nickel screen can be removed after the procedure, which screen is formed by lands consisting of metal deposits formed during the electrolysis. Obviously the lower side 2*b* of the lands can also be covered so that a ready made screen material comprising lands formed by the second increase region 5, can be removed.

It is evident that the final product of FIG. 3 can be used as such without applying stripping means such as beeswax upon the top side 2*a* and the lower side 2*b* of an initial nickel screen plate 1. The nickel screen base plate 1 conveniently has a thickness of 75 micron.

What is claimed is:

1. Process of electrolytically producing screen material by depositing a metal upon a basic screen material disposed within an electrolytic bath that includes at least one brightener, characterized in that the metal is deposited on the basic screen material by using a pulsed current whereby metal is deposited substantially perpendicular to the basic screen material and apertures through the screen material are substantially as large as those apertures through the basic screen material.

2. Process as claimed in claim 1, characterized in that the brightener has the properties of second class brighteners comprising at least one unsaturated bond excluding a

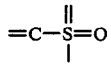

group.

3. Process as claimed in claim 1, wherein the pulsed current occurs in cycles each consisting of alternate pulse current and non-current pulse durations.

4. Process as claimed in claim 3, wherein the ratio of the length of the alternate pulse current to the remainder of the cycle is T:T, T and $T^1$ each being adjustable between 0.1 and 9900 msec., the lengths of the pulse current durations of the pulsed current preferably being comprised between 0.1 and 10 msec.

5. Process as claimed in claim 3, wherein the ratio between the length of a pulse current duration T and the length of the non-current pulse duration or reverse pulse current duration $T^1$ is comprised between 1:1 and 1:1000.

6. Process as claimed in claim 1, wherein a pulse current duration is subdivided into small pulse and non pulse current durations t and $t^1$, the frequency $$f = \frac{1}{t + t^1}$$

being selected between $10^2$ and $10^4$ Hz and the ratio $$C = \frac{1}{t + t^1} \times 100\%$$

between 0 and 100%.

7. Process as claimed in claim 3, wherein the ratio of the length of the alternate pulse current to the remainder of the cycle is T:T, T and $T^1$ each being adjustable between 0.1 and 9900 msec., the lengths of the pulse current durations of the pulsed current preferably being comprised between 0.1 and 1 msec.

8. Process as claimed in claim 3, wherein the ratio between the length of a pulse current duration T and the length of the non-current pulse duration or reverse pulse current duration $T^1$ is comprised between 1:5 and 1:20.

9. Process as claimed in claim 3, wherein the ratio between the length of a pulse current duration T and the length of the non-current pulse duration or reverse pulse current duration $T^1$ is comprised between 1:5 and 1:15.

10. Process as claimed in claim 1, wherein the pulsed current occurs in cycles each consisting of alternate pulse and reverse pulse current durations.

11. Process as claimed in claim 10, wherein the ratio of the length of the alternate pulse current to the remainder of the cycle is T:T, T and $T^1$ each being adjustable between 0.1 and 9900 msec., the lengths of the pulse current durations of the pulsed current preferably being comprised between 0.1 and 10 msec.

12. Process as claimed in claim 10, wherein the ratio of the length of the alternate pulse current to the remainder of the cycle is T:T, T and $T^1$ each being adjustable between 0.1 and 9900 msec., the lengths of the pulse current durations of the pulsed current preferably being comprised between 0.1 and 1 msec.

13. Process as claimed in claim 10, wherein the ratio between the length of a pulse current duration T and the length of the non-current pulse duration or reverse pulse current duration $T^1$ is comprised between 1:5 and 1:20.

14. Process as claimed in claim 10, wherein the ratio between the length of a pulse current duration T and the length of the non-current pulse duration or reverse pulse current duration $T^1$ is comprised between 1:5 and 1:15.

* * * * *